US009310110B2

(12) United States Patent
Hung et al.

(10) Patent No.: US 9,310,110 B2
(45) Date of Patent: Apr. 12, 2016

(54) THERMOELECTRIC DRINKING APPARATUS AND THERMOELECTRIC HEAT PUMP

(75) Inventors: Ming-Lang Hung, Hsinchu (TW); Jyi-Ching Peng, Hsinchu (TW); Ya-Wen Chou, Hsinchu (TW); Yi-Ray Chen, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 537 days.

(21) Appl. No.: 13/157,608

(22) Filed: Jun. 10, 2011

(65) Prior Publication Data

US 2012/0073309 A1 Mar. 29, 2012

(30) Foreign Application Priority Data

Sep. 29, 2010 (TW) ..... 99132966 A

(51) Int. Cl.
*F25B 21/00* (2006.01)
*F25B 21/02* (2006.01)
*F25D 3/00* (2006.01)

(52) U.S. Cl.
CPC ..... *F25B 21/02* (2013.01); *F25B 2321/0252* (2013.01); *F25D 2331/806* (2013.01)

(58) Field of Classification Search
CPC .... F25B 21/02; F25B 21/04; F25B 2321/021; F25B 2321/002; F25B 2321/0252; F25B 2321/023; F24F 3/147; B67D 1/0862; B67D 1/0857
USPC ..... 62/3.1–3.7, 389, 390
See application file for complete search history.

(56) References Cited

U.S. PATENT DOCUMENTS 4,744,220 A * 5/1988 Kerner et al. ..... 62/3.3
6,477,844 B2 * 11/2002 Ohkubo et al. ..... 62/3.7

(Continued)

FOREIGN PATENT DOCUMENTS

CN 2558919 Y 7/2003
CN 101278807 A 10/2008

(Continued)

OTHER PUBLICATIONS

Machine translation of Takimoto Masateru, Cool/Hot Liquid Container Utilizing Peltier Effect, 18.4.1995; PAJ, JP 07-101497, all.*

(Continued)

*Primary Examiner* — Allen Flanigan
*Assistant Examiner* — Filip Zec
(74) *Attorney, Agent, or Firm* — Rabin & Berdo, P.C.

(57) ABSTRACT

A thermoelectric drinking apparatus has a feeding pipe, a cooling-gain circulating loop, a heating-gain circulating loop, an outlet pipe, and a thermoelectric heat pump. The thermoelectric heat pump has a cooling unit attached to the cold side of a thermoelectric chip, which has a cooling channel in its interior, and a heating unit attached to the hot side of the thermoelectric chip and provided with a heating channel in its interior. The feeding pipe conducts fluid into the cooling channel and the heating channel respectively. The cooling-gain and heating-gain circulating loop respectively cause fluids in the cooling channel and heating channel to create circular flows, such that the cold side and hot side of the thermoelectric chip respectively cool and heat the fluids via the cooling channel and heating channel. The outlet pipe discharges the cooled and/or heated fluids respectively from the cooling-gain circulating loop and heating-gain circulating loop.

21 Claims, 15 Drawing Sheets

(56) References Cited

U.S. PATENT DOCUMENTS

| | | | | |
|---|---|---|---|---|
| 2003/0218865 | A1* | 11/2003 | Macias | 361/700 |
| 2004/0112571 | A1* | 6/2004 | Kenny et al. | 165/80.3 |
| 2008/0092553 | A1* | 4/2008 | Hochgraeber et al. | 62/3.6 |
| 2008/0098750 | A1* | 5/2008 | Busier | 62/3.3 |
| 2009/0126370 | A1 | 5/2009 | Tsai | |
| 2010/0212333 | A1* | 8/2010 | Moon et al. | 62/85 |

FOREIGN PATENT DOCUMENTS

| | | | |
|---|---|---|---|
| CN | 201532052 | U | 7/2010 |
| CN | 201561603 | U | 8/2010 |
| JP | 02-208475 | | 8/1990 |
| JP | 1992-062373 | A | 2/1992 |
| JP | 05-172425 | A | 7/1993 |
| JP | 07-101497 | | 4/1995 |
| JP | 3022653 | U | 3/1996 |
| JP | 08-210748 | | 8/1996 |
| JP | 10-38431 | | 2/1998 |
| JP | 10-277678 | | 10/1998 |
| JP | 2002-147888 | A | 5/2002 |
| JP | 2005-024194 | A | 1/2005 |
| JP | 2006- 057891 | A | 3/2006 |
| JP | 2008-186913 | A | 8/2008 |
| JP | 2008-232502 | A | 10/2008 |
| JP | 2010-151427 | A | 7/2010 |
| TW | 168296 | | 9/1991 |
| TW | 220374 | | 2/1994 |
| TW | 453430 | U | 9/2001 |
| TW | M284852 | U | 1/2006 |
| TW | M285680 | | 1/2006 |
| TW | M287420 | U | 2/2006 |
| TW | M287424 | U | 2/2006 |
| TW | I294510 | | 3/2008 |
| TW | I296473 | B | 5/2008 |
| TW | M378363 | | 4/2010 |

OTHER PUBLICATIONS

Teraki, Constant-Temperature Liquid Supply Device, 27.1.2005, PAJ, 2005-024194, all.*

Di Liu et al., "Modeling and Performance Investigation of a Closed-Type Thermoelectric Clothes Dryer", Drying Technology, 26: 1208-1216, 2008.

Qinghai Luo et al., "A novel water heater integrating thermoelectric heat pump with separating thermosiphon", Applied Thermal Engineering 25 (2005) 2193-2203.

Gao Min et al, "Thermoelectric figure-of-merit under large temperature differences", J. Phys. D: Appl. Phys. 37 (2004) 1301-1304.

Howard Chen, "A Novel VLSI Technology to Manufacture High-Density Thermoelectric Cooling Devices", © EDA Publishing/Therminic 2007, pp. 1-6.

Kuan Chen et al., "An Analysis of the Heat Transfer Rate and Efficiency of TE(Thermoelectric) Cooling Systems" International Journal of Energy Research, vol. 20, 399-417 (1996).

Velimir Jovanovic et al., "Design, Fabrication and Testing of Energy-Harvesting Thermoelectric Generator", Proc. of SPIE vol. 6173, 61730G 1-8.

Terry J. Hendricks et al., "Thermal System Interactions in Optimizing Advanced Thermoelectric Energy Recovery Systems" Journal of Energy Resources Technology, September 2007, vol. 129, 223-231.

C. K. Loh et al, "Investigation into the use of Thermoelectric Devices as Heat Source for Heat Sink Characterization".

Jin Xie et al, "Design, Fabrication, and Characterization of CMOS MEMS-Based Thermoelectric Power Generators", Journal of Microelectromechanical Systems, vol. 19, No. 2, Apr. 2010, pp. 317-324.

Gao Min et al., "Experimental evaluation of prototype thermoelectric domestic-refrigerators", Applied Energy 83 (2006) 133-152.

Banjerd Saengchandr et al., "A Novel Approach for Cooling Electronics Using a Combined Heat Pipe and Thermoelectric Module", American J. of Engineering and Applied Sciences 2 (4): 603-610, 2009.

Japan Patent Office, Office Action, Patent Application Serial No. 2011211107, Mar. 25, 2014, Japan.

Japan Patent Office, Notice of Allowance issued on Nov. 4, 2014.

* cited by examiner

THERMOELECTRIC DRINKING APPARATUS AND THERMOELECTRIC HEAT PUMP

TECHNICAL FIELD

The disclosure relates generally to a thermoelectric drinking apparatus and a thermoelectric heat pump, and more particularly, to a thermoelectric drinking apparatus and a thermoelectric heat pump with a cooling unit and a heating unit of a built-in channel structure of heat exchangers.

BACKGROUND

Conventional water dispensers can be divided into two types by different temperature ranges: hot/warm and hot/warm/cold. The operating principle is to directly or indirectly heat a hot-water storage tank and cool a cold-water storage tank to obtain the constant temperature of water, while the warm water is generated by mixing the hot water and the cold water.

For example, FIGS. 1 and 2 of the Taiwan Patent No. 1294510 disclose a technique for obtaining the hot water by heating directly with a heating tube within the hot-water tank and indirectly with a heater outside the hot-water tank respectively. In addition, FIG. 2 of the Taiwan Patent No. M285680 discloses a technique for obtaining the cold water by a compressor connected to the cold-water tank. However, there is a limitation of heating efficiency on the direct and indirect heating method with the heating tube and the heater, because the heating area is limited to a single point or a portion. Next, the cooling operation implemented in the dispenser with the compressor would contain disadvantages of large volume, refrigerant contamination and excess energy consumption indirectly.

Thermoelectric technologies have been applied for cooling and heating via charge carrier movement without any mechanical motion. Recently, the design of using a thermoelectric chip to provide the dispenser with cooling and heating operation becomes gradually popular in the market place. As shown in FIG. 1, a dispenser 1 for cooling operation with a thermoelectric chip is shown. The cold side 10*c* of the thermoelectric chip 10 is attached to the cold tank 11 for cooling the fluid therein. The hot side 10*h* of the thermoelectric chip 10 is provided with a heat sink 12 and a fan 13, in order to exchange the heat from the hot side 10*h* of the thermoelectric chip 10 to environment by the heat sink 12 and the fan 13.

In general, the dispenser for cooling/heating operation by a thermoelectric chip has advantages of a more stable condition and lower maintenance. In a conventional water dispenser system, the redundant heat exchanges from the hot side 10*h* to environment and consumes most of valuable heat energy. Moreover, the vibration and noise generated by the compressor and fan 13 during operation are big issues on household appliances. In addition, the current cooling/heating method of attracting the cooling/heating energy of the thermoelectric chip to the tank is not efficiently. Hence, a water dispenser system design for cooling/heating with the thermoelectric chip should be improved.

SUMMARY

In view of the above-mentioned disadvantages of the prior techniques, an object of the disclosure is to provide a thermoelectric drinking apparatus and a thermoelectric heat pump thereof with a better cooling and heating efficiency.

Another object of the disclosure is to provide a thermoelectric drinking apparatus and a thermoelectric heat pump thereof for cooling without a compressor.

A further object of the disclosure is to provide a thermoelectric drinking apparatus and a thermoelectric heat pump thereof for heating, without providing a fan and a heat sink for exchanging heat to air.

To achieve this object and other objects, the disclosure provides a thermoelectric drinking apparatus, the thermoelectric drinking apparatus comprised a thermoelectric heat pump, a cooling unit, a heating unit, feeding pipes, a cooling-gain circulating loop, a heating-gain circulating loop. The thermoelectric heat pump includes one and plural thermoelectric chips having cold side for absorbing heat and hot side for releasing heat. Cooling unit is attached to the cold side of the thermoelectric chips and providing cooling channels therein and heating unit is attached to the hot side of the thermoelectric chips and providing heating channels therein. The feeding pipes for conducting fluid into the cooling channels of the cooling unit and the heating channels of the heating unit respectively. The cooling-gain circulating loop is coupled to the cooling unit for creating a circular flow to enhance heat exchanging rate. The thermoelectric chips cool the fluid as it flows in the cooling channels via the cooling unit. The heating-gain circulating loop is coupled to the heating unit for making the fluid into the heating channels conducted by the feeding pipe and the created circular flow, so as to make the thermoelectric chips heated the fluid flowing in the heating channels via the heating unit. The outlet pipes are coupled to the cooling-gain circulating loop and heating-gain circulating loop for discharging the cooled fluid and the heated fluid respectively to water storage units.

In the preferred embodiment of the disclosure, the thermoelectric heat pump includes a plurality of thermoelectric chips having cold side and hot side, and a plurality of cooling units and heating units connected in series or parallel with each other. The cooling channels and the heating channels are constructed by U-shaped channels with fluid inlet and outlet are in the opposite side of unit, U-shaped channels with fluid inlet and outlet are in the same side of unit, helical channels with unidirectional flow type, helical channels with cross-flow type or U-shaped channels with cross-flow type.

Compared to conventional water dispensers, the thermoelectric drinking apparatus of the disclosure has better cooling and heating efficiency and less energy loss by means of using the thermoelectric chip, the cooling channels, the heating channels, the cooling-gain circulating loop, and the heating-gain circulating loop, while fully cooling and heating the fluid in the cooling channels and the heating channels. Furthermore, since the thermoelectric drinking apparatus of the disclosure do not include compressor, the fan and air-side exchanger or the like; thus in addition to effectively reducing the overall volume, lacking of refrigerant contamination and reducing energy consumption.

DETAILED DESCRIPTION OF PREFERRED EMBODIMENTS

The following illustrative embodiments are provided to illustrate the disclosure, and these and other advantages and effects can be apparently understood by those in the art after reading the disclosure. The disclosure can also be performed or applied by other different embodiments. The details of the specification may be carried out based on different points and applications, and numerous modifications and variations can be devised without departing from the spirit of the disclosure.

Furthermore, the disclosures of the instructions are simplified schematic diagrams, only indicating the basic technical idea of the disclosure, so the actual implementation of each component type, quantity and proportion of visual implementation of the requirements change.

Figure 1:
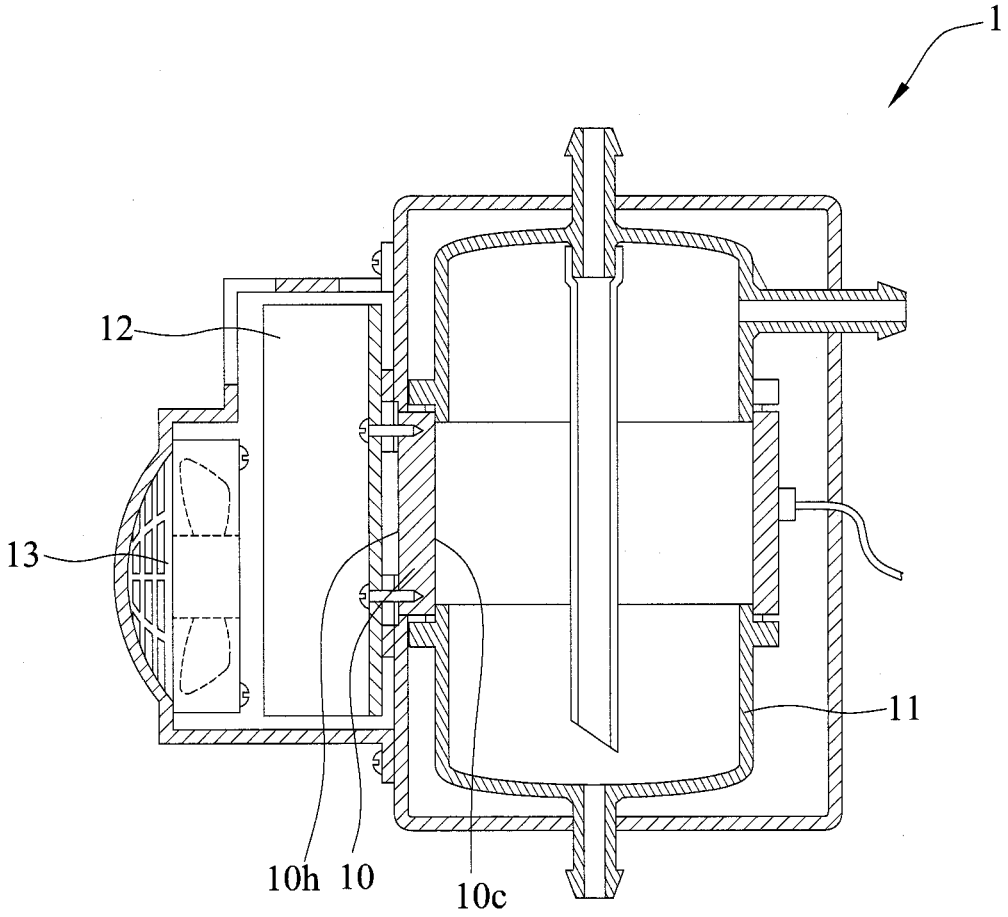
FIG. 1 (PRIOR ART)
FIG. 1 is a schematic diagram of a dispenser for cooling operation with a thermoelectric chip according to conventional strategies.
Figure 2:
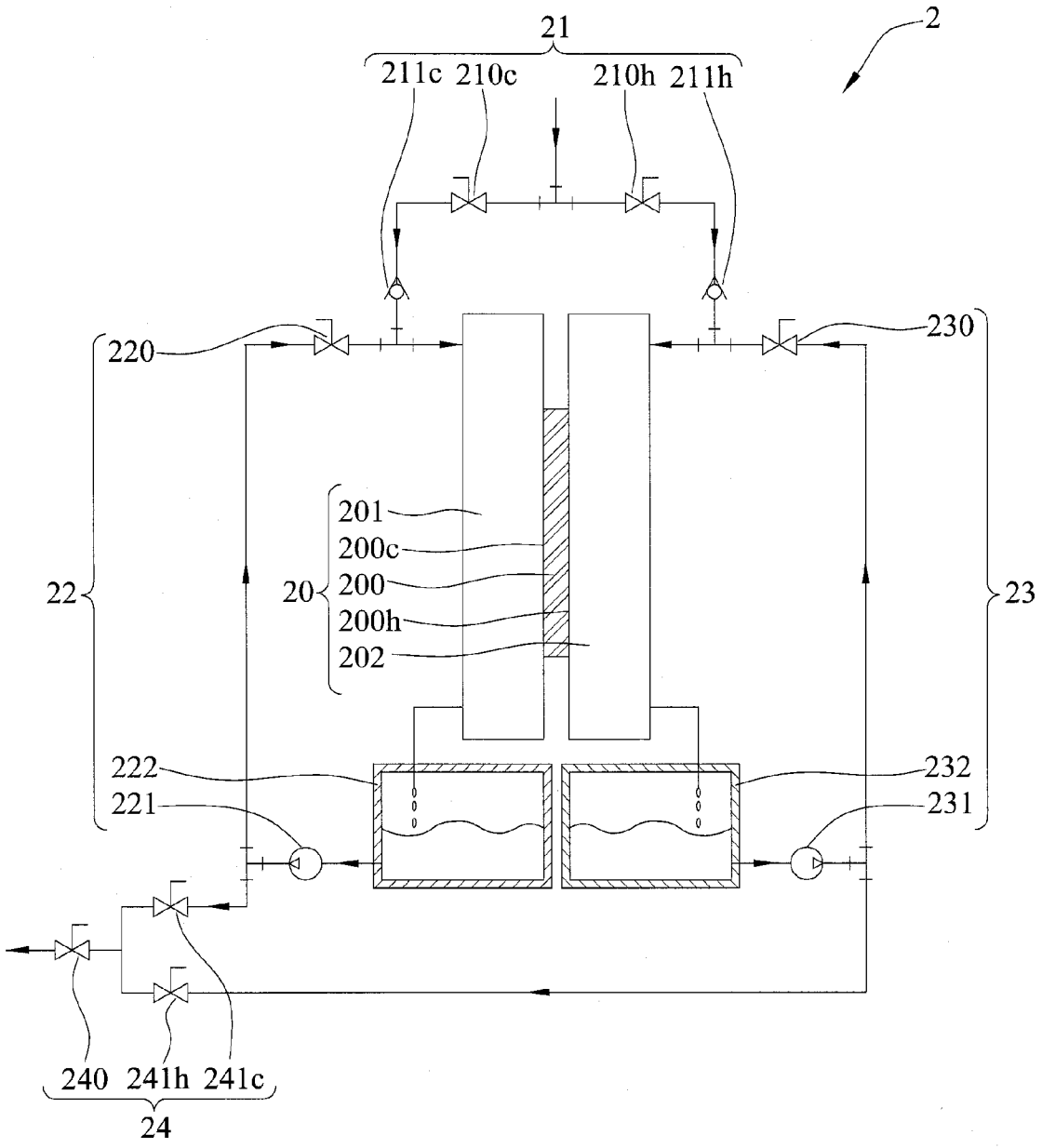
FIG. 2 is a schematic diagram of a thermoelectric drinking apparatus according to the disclosure.

Referring to FIG. 2, a schematic diagram of a thermoelectric drinking apparatus according to the disclosure is shown. The thermoelectric drinking apparatus 2 comprises a thermoelectric heat pump 20, a feeding pipe 21, a cooling-gain circulating loop 22, a heating-gain circulating loop 23, and an outlet pipe 24.

The thermoelectric heat pump 20 includes a thermoelectric chip 200, a cooling unit 201 and a heating unit 202. The thermoelectric chip 200 has a cold side 200*c* for absorbing heat and a hot side 200*h* for rejecting heat. The cooling unit 201 is attached to the cold side 200*c* of the thermoelectric chip 200, and a cooling channel is built therein for the fluid flow. The heating unit 202 is attached to the hot side 200*h* of the thermoelectric chip 200, and a heating channel is built therein for the fluid flow. During an operation period, due to charges carry energy to move, the thermoelectric chip 200 absorbs heat energy from environment at a cold side 200*c* and rejects heat energy to a heating side 200*h*. In that the thermoelectric chip is functioning cooling and heating effect at the same time, the amount of heat energy is equal to the input electrical energy and energy absorbed from the cold side. Therefore, thermoelectric heat pump effects on the enhancement of heating rate and saving energy.

A cooling unit 201 and a heating unit 202 can be encapsulated by forming one or a combination. The cooling unit 201 and the heating unit 202 may be a single-piece or combined into one piece. A cooling channel and a heating channel are provided within the interior of the cooling unit 201 and the heating unit 202. The cooling channel and the heating channel may be U-shaped channels with fluid inlet and outlet are in the opposite side of unit, U-shaped channels with fluid inlet and outlet are in the same side of unit, helical channels with unidirectional flow type, helical channels with cross-flow type or U-shaped channels with cross-flow type, for fluid flowing therein. The configurations of the cooling channel and the heating channel described in detail below.

The feeding pipe 21 is used to conduct fluid into the cooling channel of the cooling unit 201 and the heating channel of the heating unit 202 respectively. The cooled fluid cooled by the cooling unit 201 flows into a cooled fluid tank (also referred to as a cold-water tank) 222. The heated fluid heated by the heating unit 202 flows into a heated fluid tank (also referred to as a hot-water tank) 232. In the embodiment, the feeding pipe 21 may be provided with an inlet valve 210*c* and 210*h* and a check valve 211*c* and 211*h* selectively. The inlet valve 210*c* is used to conduct the fluid into the cooling channel of the cooling unit 201. The inlet valve 210*h* is used to conduct the fluid into the heating channel of the heating unit 202. The check valve 211*c* is used to prevent the fluid conducted by the feeding pipe 21 into the cooling channel of the cooling unit 201 flow reversely. The check valve 211*h* is used to prevent the fluid conducted by the feeding pipe 21 into the heating channel of the heating unit 202 flow reversely.

One end of the cooling-gain circulating loop 22 is connected to the cooling unit 201 and the other end is connected to the cooled fluid tank 222 for making the fluid conducted by the feeding pipe 21 into the cooling channel flow circularly. The cold side 200*c* of the thermoelectric chip 200 cools the fluid circularly flowing in the cooling channel via the cooling channel built in the cooling unit 201. In the embodiment, the cooling-gain circulating loop 22 may selectively be provided with a cold control valve 220 for opening or closing the circularly flow of the fluid in the cooling channel, and a cold-side booster pump 221 for improving heat transfer rate of the fluid in the cooling channel. When the temperature of the cooled fluid in the cooled fluid tank 222 is set below 8° C., the operation of the cold-side booster pump 221 stops running and the cold control valve 220 is closed. The cooling-gain circulating loop 22 is used to store the cooled fluid in the cooled fluid tank 222. The cooled fluid tank 222 may be provided with a switch (not shown) for flowing the cooled fluid. To maintain temperature of water, the cooled fluid tank 222 may be coated by an insulation layer (not shown) on outer surface of water tank.

One end of the heating-gain circulating loop 23 is connected to the heating unit 202 and the other end is connected to the heated fluid tank 232 for making the fluid conducted by the feeding pipe 21 into the heating channel flow circularly. The hot side 200*h* of the thermoelectric chip 200 heats the circulating fluid in the heating channel via the heating channel built in the heating unit 202. In the embodiment, the heating-gain circulating loop 23 may selectively be provided with a hot control valve 230 for opening or closing the circularly flow of the fluid in the heating channel and a hot-side booster pump 231 for increasing heat transfer rate of the fluid in the heating channel. The operation of the hot-side booster pump 231 is stop and the hot control valve 220 is closed at the time the temperature of the heated fluid in the heated fluid tank 232 is set above 85° C. The heating-gain circulating loop 23 is used to store the heated fluid in the heated fluid tank 232. The heated fluid tank 232 may be provided with a switch (not shown) to control the cold flow. To maintain temperature of water, the heated fluid tank 232 can be coated by an insulation layer (not shown) on the outer surface of water tank.

The outlet pipe 24 is connected to the cooling-gain circulating loop 22 and the heating-gain circulating loop 23 for respectively discharging the cooled and/or heated fluid from the cooling-gain circulating loop 22 and the heating-gain circulating loop 23. In the embodiment, the outlet pipe 24 may selectively be provided with an outlet valve 240 and flow control valves 241*c* and 241*h*. The outlet valve 240 is used to conduct the cooled and heated fluid from the cooling-gain circulating loop 22 and the heating-gain circulating loop 23 respectively. The flow control valve 241*c* is used to control flow of the outlet pipe from the cooling-gain circulating loop 22. The flow control valve 241*h* is used to control flow of the outlet pipe from the heating-gain circulating loop 23. At this time, the cold control valve 220 and the hot control valve 230 are closed; the cold boost pump 221 and the hot boost pump 231 are operated. However, the gravity can also be used for directly flow from the cooled fluid tank 222 and the heated fluid tank 232. The pipe is not shown and no boost pump is needed.

Specifically, tap water treated as water source, upon tap water flows into the cooling unit 201 or the heating unit 202 respectively, the thermoelectric chip 200 is driven by a controller (not shown). Simultaneously, tap water flows into the cooling-gain circulating loop 22 and the heating-gain circulating loop 23. Tap water circulates inside the circulating loop 21 until the water temperature reached the design points. Since the thermoelectric chip 200 absorbs heat from the cold side 200*c* and rejects heat to the hot side 200*h* after the chip is driven, the thermoelectric chip 200 is cooling and heating the tap water during it flows through the cooling channel and the heating channel. The cooling channel and the heating channel therein increase the cooling/heating time and the heat exchange area of the tap water in the cooling/heating unit 201/202, thereby the cooling and the heating efficiency are improved.

When the thermoelectric drinking apparatus 2 detects the cooling or the heating temperature reached the design points by a sensor (not shown), i.e., the tap water in the cooling unit 201 and the heating unit 202 flow out and store in the cooled fluid tank 222 or the heated fluid tank 232 respectively. Based on the users need, the thermoelectric drinking apparatus 2 may flow out cooled fluid or heated fluid through the outlet pipe 24 from the cooled fluid tank 222 or the heated fluid tank 232 by the controller (not shown). A certain percentage of the cooled fluid and the heated fluid from the cooled fluid tank 222 and the heated fluid tank 232 respectively mixed into different appropriate temperature based on the requirement of user.

It is noted that the thermoelectric drinking apparatus 2 of the disclosure may be combine with a reverse osmosis (RO) water filtration system and/or UV sterilization devices for improving the safety of drinking water. The reverse osmosis equipment and UV disinfection device may be selectively connected to the feeding pipe 21 or the outlet pipe 24. Next, according to different design requirements and cost limitation, the number of the thermoelectric chip 200 contained in the thermoelectric heat pump 20 and the number of the thermoelectric heat pump 20 can be the design option. For example, the thermoelectric heat pump 20 may consist of plural thermoelectric chips 200, and the thermoelectric drinking apparatus 2 may consist of plural thermoelectric heat pumps 20 which connected in series or parallel with each other.

As shown in FIG. 2, the cooling unit 201 is a combination unit including a cooling body 2010 with cooling channel 20100 built therein, a cooling sealing gasket 2011 on a cooling gasket groove 20101 and a cooling sealing cover 2012 for covering the cooling body 2010. The cooling channel 20100 may be a U-shaped channel with flow inlet and outlet on the opposite side of unit. The cooling sealing cover 2012 and the cooling body 2010 have screw holes 20120 and 20102 corresponding to each other for passing through screws 20121 of fixing the cooling sealing cover 2012 on the heating body 2010 and the cooling sealing gasket 2011 in the cooling gasket groove 20101 of the cooling body 2010. Certainly, the cooling sealing cover 2012 may also be fixed on and sealed with the heating body 2010 by means of bonding or folding.

The heating unit 202 may have the same configuration with the cooling unit 201, that is, the heating unit 202 also has a heating body 2020 having the heating channel (not shown) built therein, a heating sealing gasket (not shown) on a heating gasket groove (not shown) and a heating sealing cover 2022 for covering the heating body 2020. The heating channel may be a U-shaped channel with flow inlet and outlet on the opposite side of unit. The heating sealing cover 2022 and the heating body 2020 have screw holes (not shown) corresponding to each other for passing through screws (not shown) of fixing the cooling sealing cover 2022 on the heating body 2020 and the heating sealing gasket in the heating gasket groove of the heating body 2020.

In order to securely place the thermoelectric chip 200 between the cooling unit 201 and the heating unit 202, there may be provided with a cold slot (not shown) for holding the cold side 200*c* of the thermoelectric chip 200 and a hot slot 20205 for holding the hot side 200*h* of the thermoelectric chip 200 respectively on the relative surface of the cooling unit 201 and the heating unit 202.

Therefore, in this embodiment, when the fluid continuously flowed into the cooling channel 20100 from an inlet 20103 and circularly flowed in U shape channel 20100, thereby continuously flowing out of the cooling unit 201 from an outlet 20104 positioned on the opposite of the inlet 20103.

Similarly, when the fluid continuously flowed into the heating channel from an inlet 20203 and circularly flowed in the U-shaped channel, thereby continuously flowing out of the heating unit 202 from an outlet 20204 at opposite of inlet.

Figure 3A:
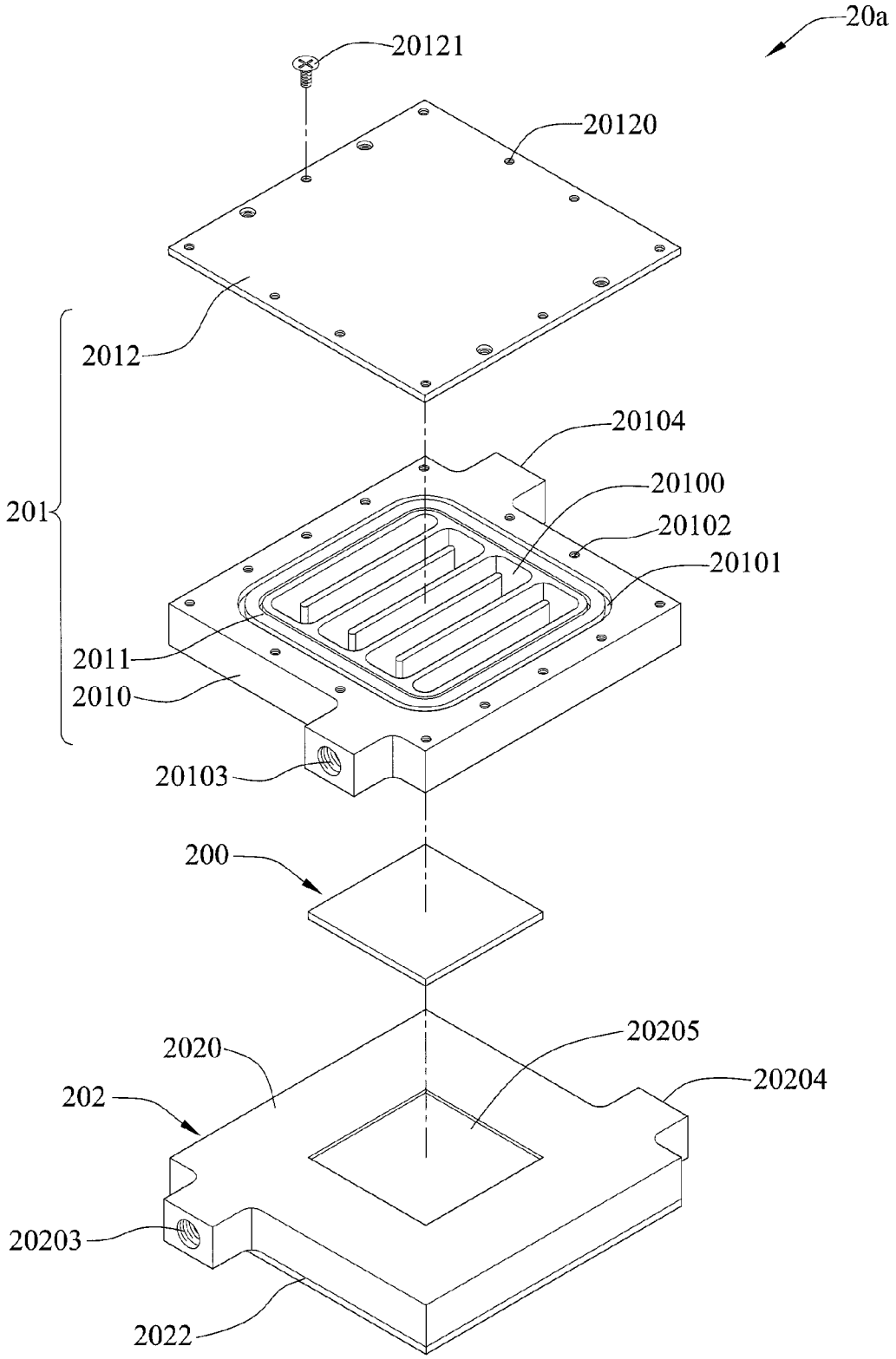
FIG. 3A is an exploded view of U-shaped channels with the inlet and the outlet of flows in the opposite sides of the unit and thermoelectric heat pump system according to the disclosure.
Figure 3B:
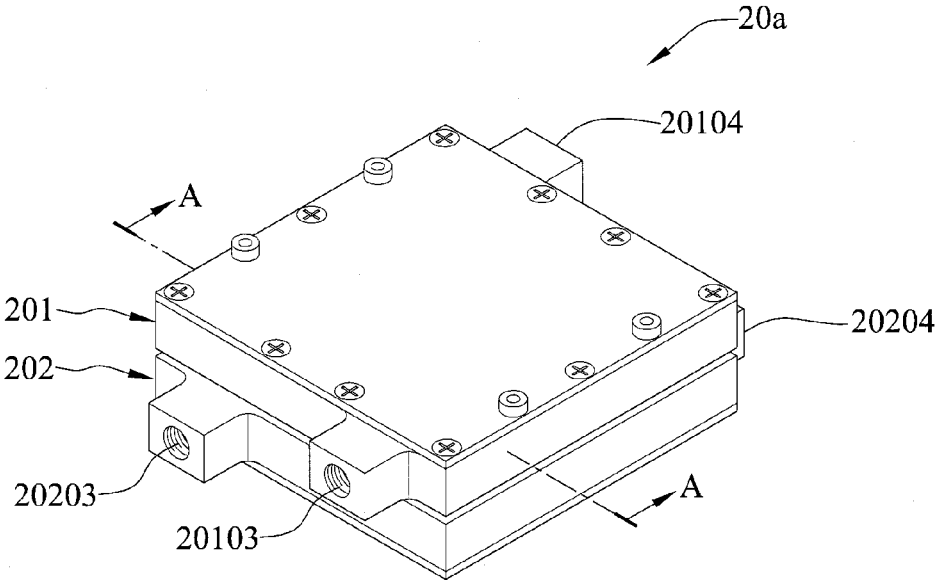
FIG. 3B is an assembly view of the U-shaped channels with the inlet and the outlet of flows on the opposite sides of the unit and thermoelectric heat pump system according to the disclosure.
Figure 3C:
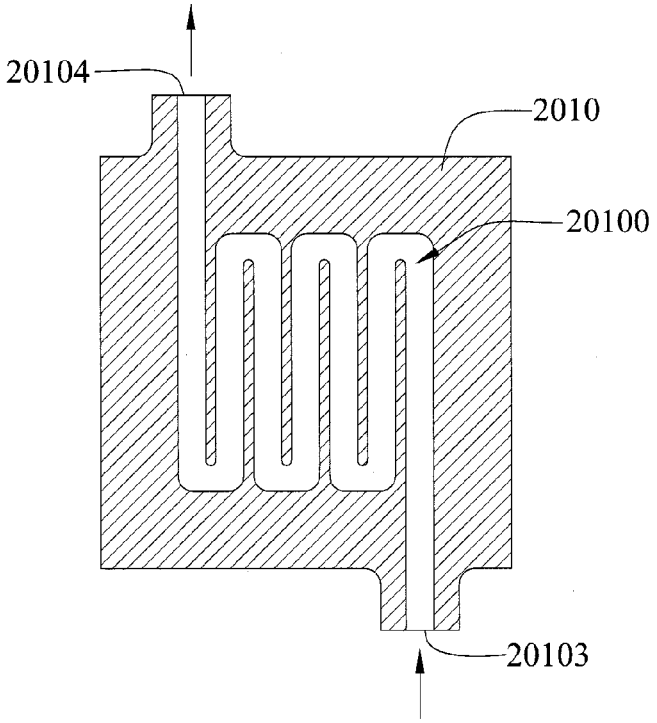
FIG. 3C is a cross-sectional view of the U-shaped channels and thermoelectric heat pump shown in FIG. 3B along a section A.
Figure 3D:
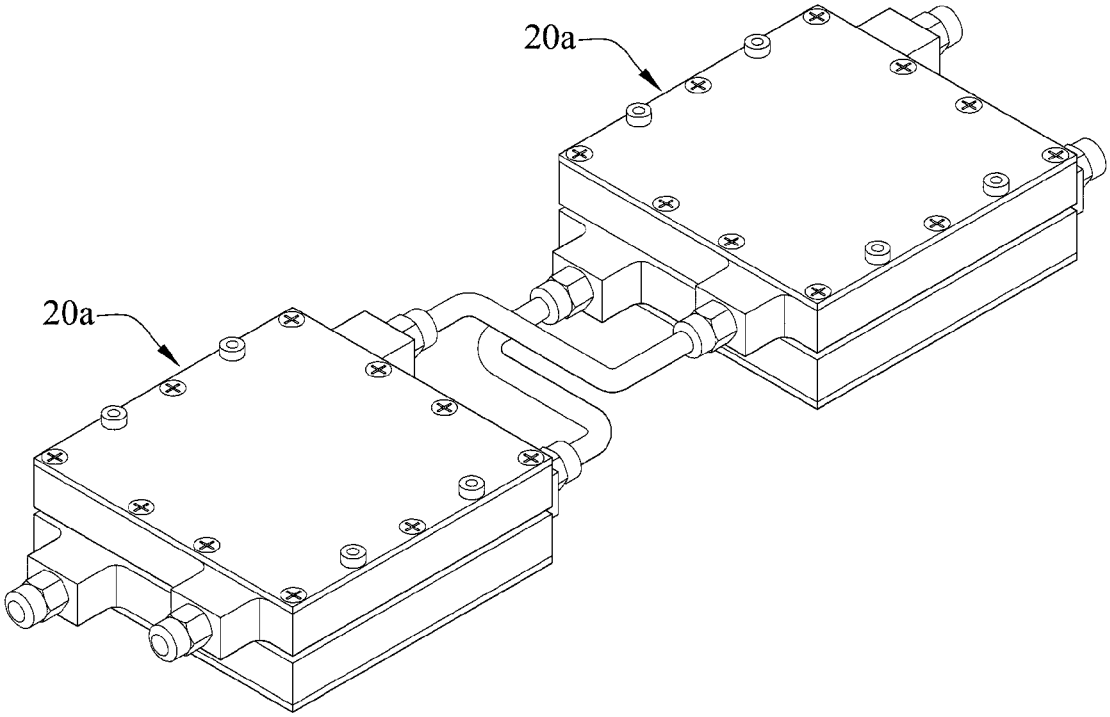
FIG. 3D is a perspective view of a plurality of U-shaped channels and thermoelectric heat pumps connected in series.

It is noted that, to obtain stage type cooling effect and heating effect, and to provide a better throughput, the thermoelectric heat pump 20*a* may be configured several and connected in series with each other, as shown in FIG. 3D. Certainly, according to the actual needs of different users, a plurality of thermoelectric heat pumps 20*a* may be flexibly configured to be connected in parallel with each other.

The fluid in the cooling channel 20100 and the heating channel may be selectively driven by other driving devices (not shown), instead of the cooling-gain circulating loop 22 and the heating-gain circulating loop 23.

Figure 4A:
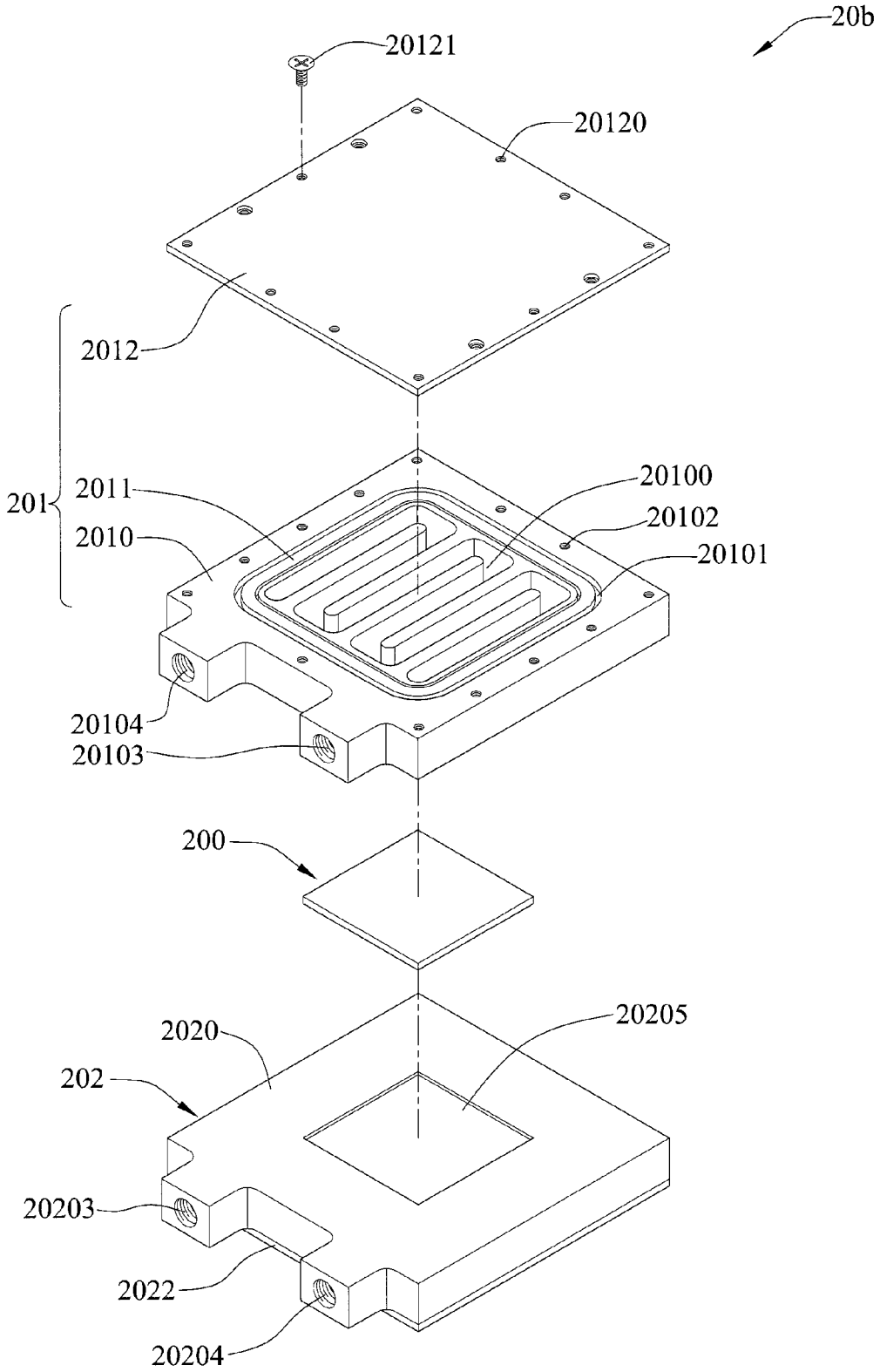
FIG. 4A is an exploded view of U-shaped channels with the inlet and the outlet of flows on the same sides of the unit and thermoelectric heat pump system according to the disclosure.
Figure 4B:
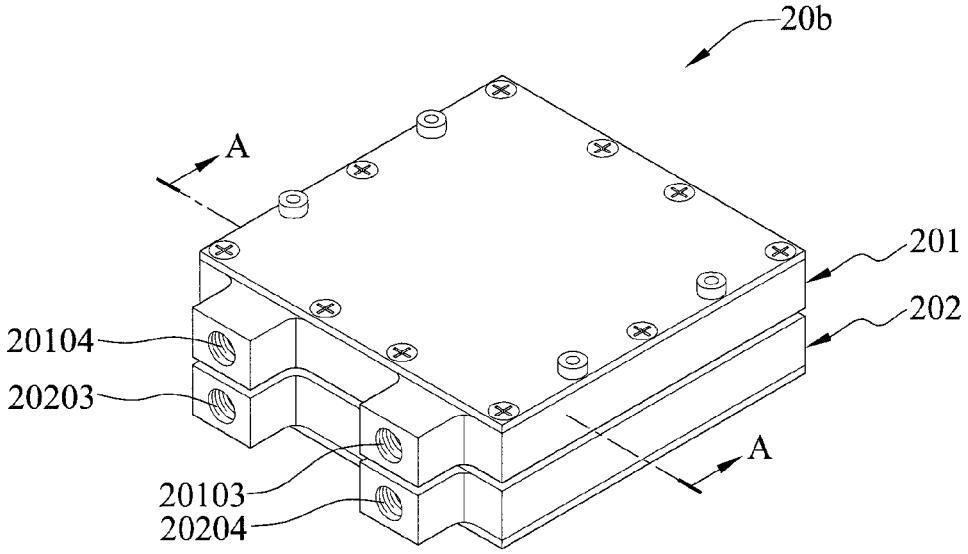
FIG. 4B is an assembly view of the U-shaped channels with the inlet and the outlet of flows on the same sides of the unit and thermoelectric heat pump system according to the disclosure.
Figure 4C:
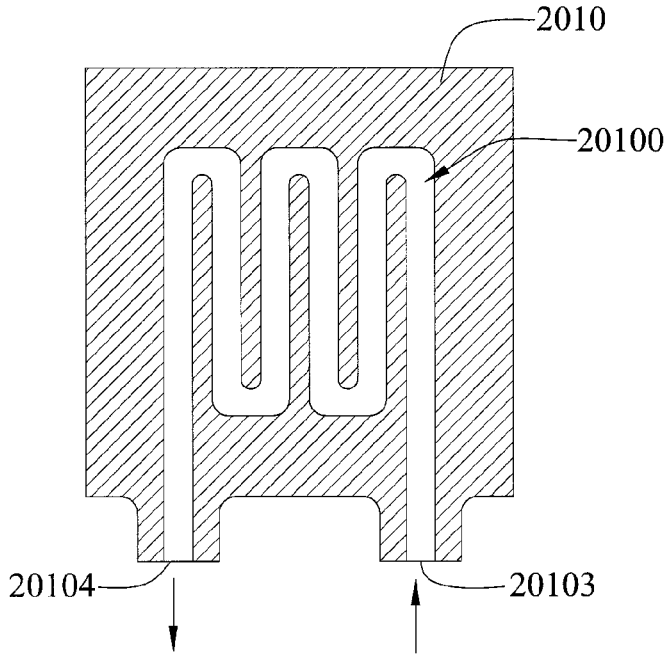
FIG. 4C is a cross-sectional view of the U-shaped channels with the inlet and the outlet of flows on the same sides of the unit and thermoelectric heat pump shown in FIG. 4B along a section A.
Figure 4D:
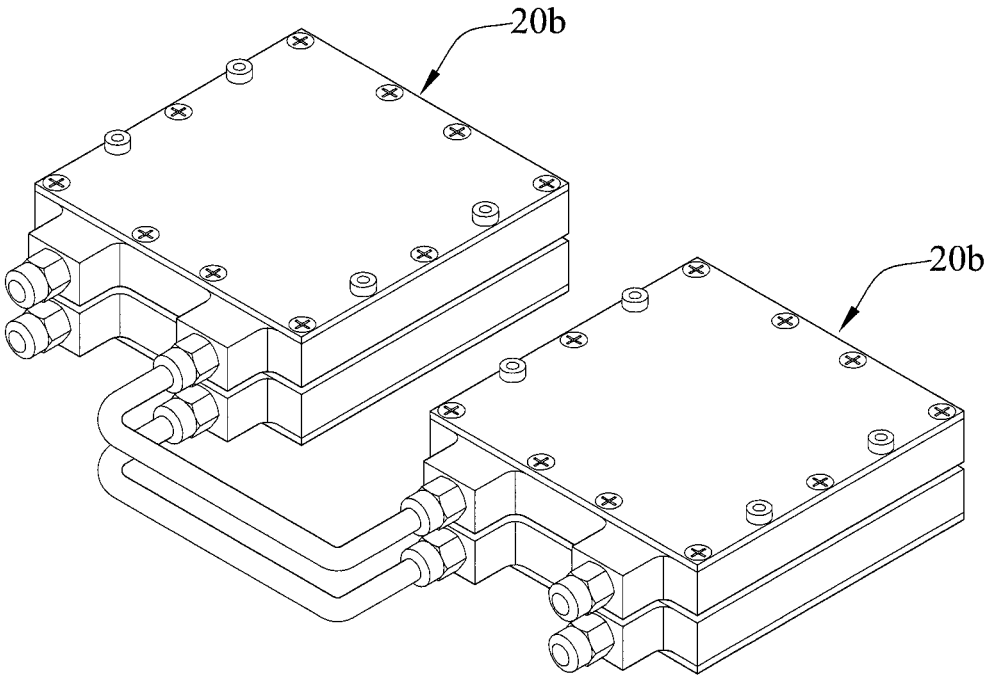
FIG. 4D is a perspective view of a plurality of U-shaped channels with the inlet and the outlet of flows on the same sides of the unit and thermoelectric heat pumps connected in series.

Referring to FIGS. 2 and 4A to 4D, a exploded view of a U-shaped channel with flow inlet and outlet at the same side of unit and thermoelectric heat pump 20*b* is shown in FIG. 4A, an assembly view of the U-shaped channel with flow inlet and outlet at the same side of unit and thermoelectric heat pump 20*b* is shown in FIG. 4B, a cross-sectional view of the U-shaped channel with flow inlet and outlet at the same side of unit and thermoelectric heat pump shown on FIG. 4B along a section A is shown in FIG. 4C and a perspective view of a plurality of U-shaped channel with flow inlet and outlet at the same side of unit and thermoelectric heat pump 20*b* connected in series is shown in FIG. 4D.

In this embodiment, the inlet 20103 and the outlet 20104 are positioned at the same side of the cooling unit 201, and the inlet 20203 and the outlet 20204 are positioned at the same side of the heating unit 202. The flowing direction of the fluid in the cooling unit 201 and the heating unit 202, as shown in FIG. 4C, is a U-shaped flow in which the inlet and the outlet are positioned at the same side. In order to obtain better cooling effect and heating effect, plural thermoelectric heat pumps 20*b* may be connected in series with each other, as shown in FIG. 4D. Certainly, according to the requirement of different users, a plurality of thermoelectric heat pumps 20*b* may be flexibly configured to be connected in parallel with each other.

Figure 5A:
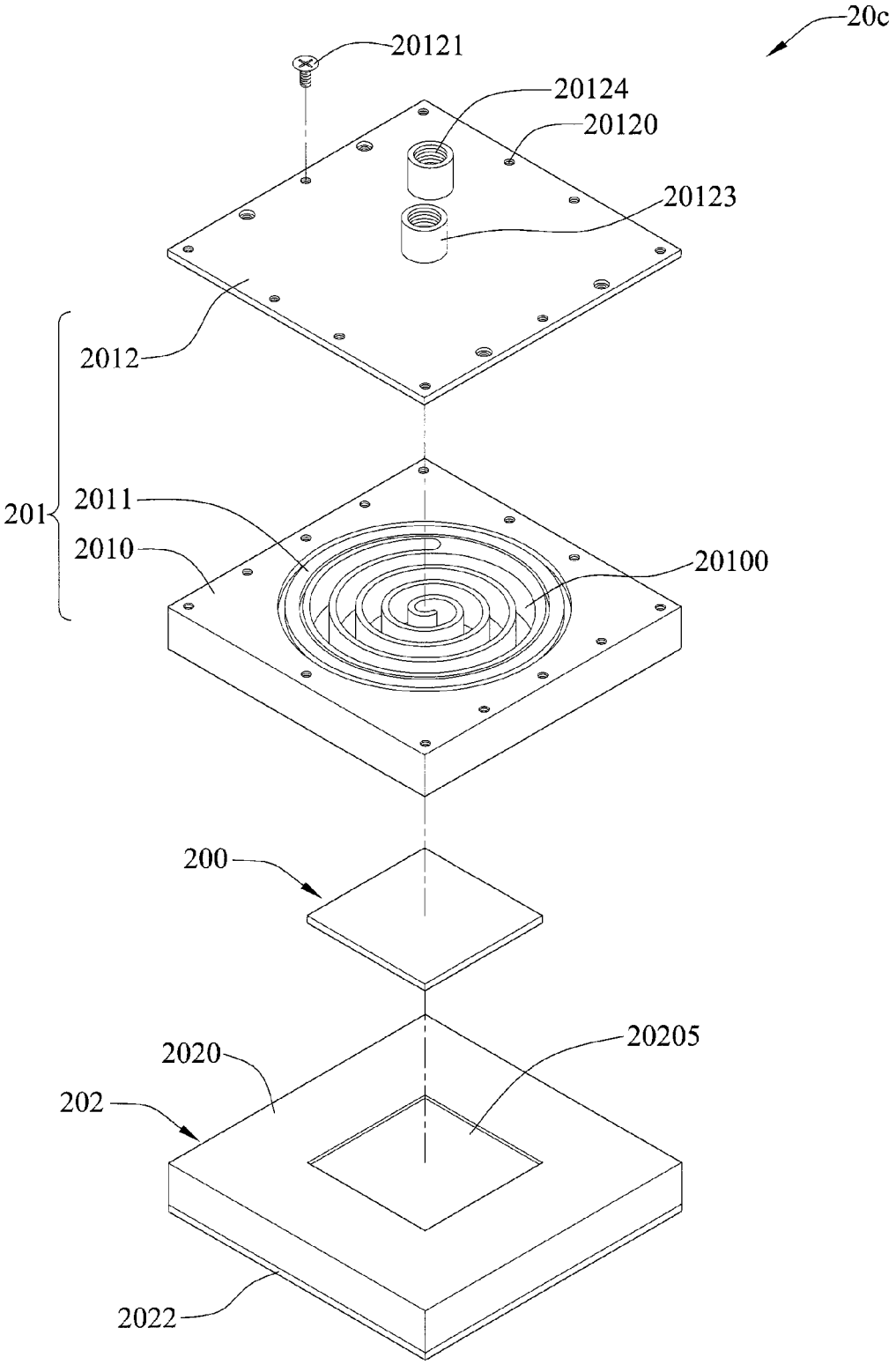
FIG. 5A is an exploded view of helical channels with a unidirectional flow type and a thermoelectric heat pump according to the disclosure.
Figure 5B:
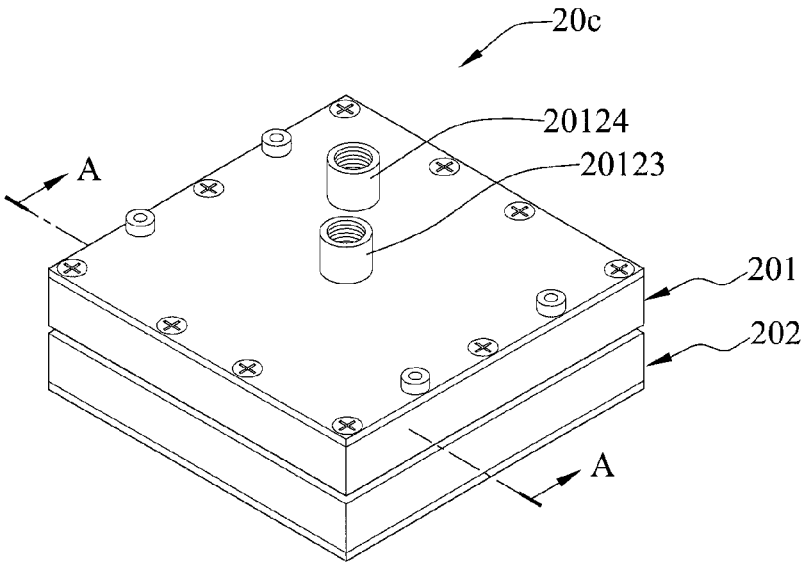
FIG. 5B is an assembly view of the helical channels with a unidirectional flow type and a thermoelectric heat pump according to the disclosure.
Figure 5C:
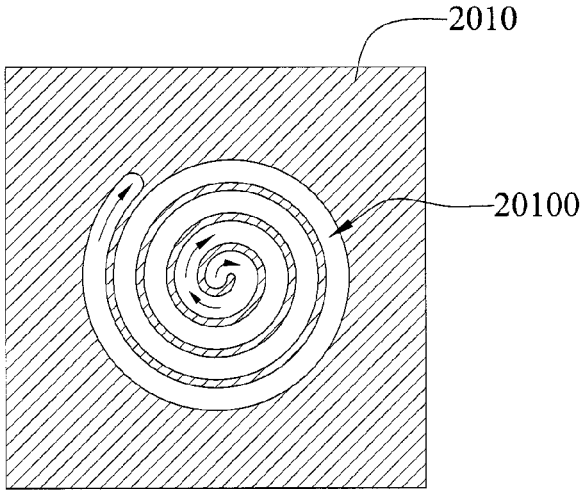
FIG. 5C is a cross-sectional view of the helical channels with a unidirectional flow type and a thermoelectric heat pump shown in FIG. 5B along a section A.

Next, referring to FIGS. 2 and 5A to 5C, a exploded view of a helical channels with unidirectional flow type and thermoelectric heat pump 20*c* is shown in FIG. 5A, an assembly view of the helical channels with unidirectional flow type and thermoelectric heat pump 20*c* is shown in FIG. 5B and a cross-sectional view of the helical channels with unidirectional flow type and thermoelectric heat pump shown on FIG. 5B along a section A is shown in FIG. 5C.

In this embodiment, the principal difference from the U-shaped channel with flow inlet and outlet on the opposite side of unit of the foregoing embodiment is the arrangement of the inlet and the outlet and the cooling channel 20100 and the heating channel (not shown) are formed of a design of the helical channels with unidirectional flow type.

As shown in the drawings, the heating body 2010 and the heating body 2020 do not provide any inlet and outlet, while the inlet 20123 is provided at the center of the cooling sealing cover 2012 and the outlet 20124 is provided at the edge of the cooling sealing cover 2012. Accordingly, the inlet (not shown) and the outlet (not shown) are also provided at the center of the heating sealing cover 2022.

Such arrangement of the inlet and the outlet used in the cooling channel 20100 and the heating channel of the helical channels with unidirectional flow type, the flowing of the fluid in the cooling unit 201 and the heating unit 202 will be shown in FIG. 5C. That is, after the fluid flows into the cooling channel 20100 and the heating channel through the inlet positioned at the center, the flowing flows to the outlet near the edge by way of a helical flow and flows out of the outlet near the edge. Certainly, according to the actual needs, plural thermoelectric heat pumps 20*c* may be configured to be connected in series or parallel with each other.

Figure 6A:
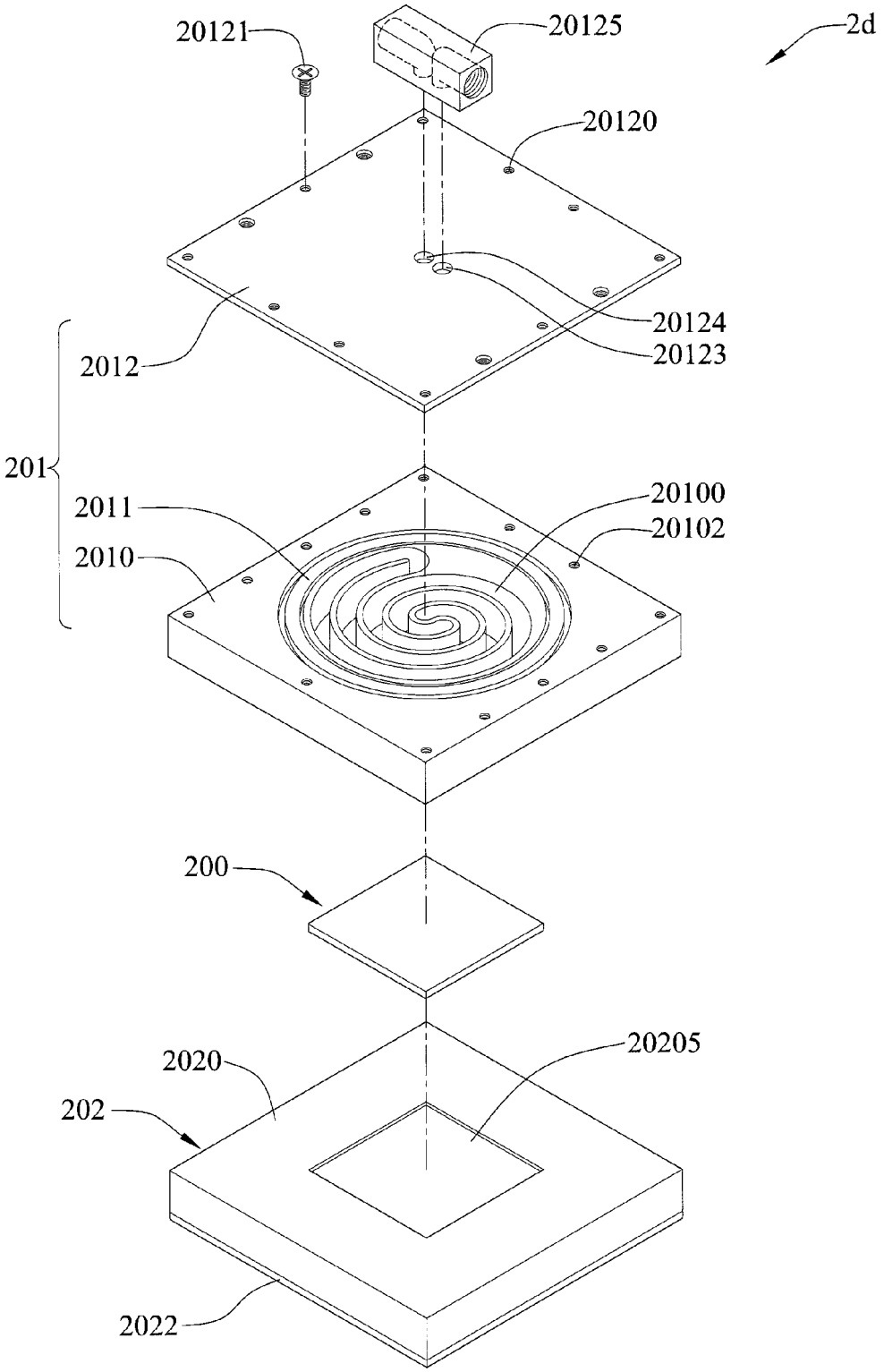
FIG. 6A is an exploded view of helical channels with a cross-flow type and a thermoelectric heat pump according to the disclosure.
Figure 6B:
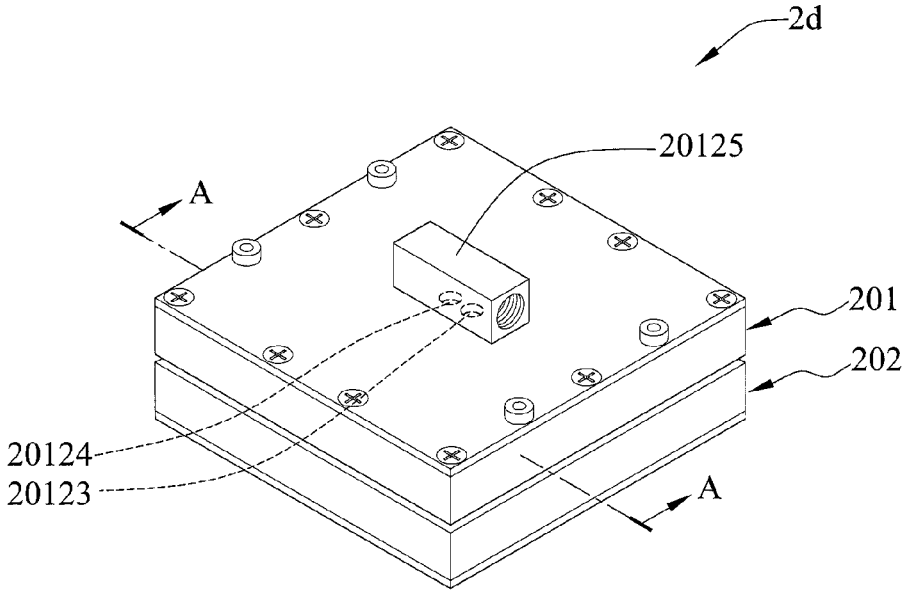
FIG. 6B is an assembly view of the helical channels with a cross-flow type and a thermoelectric heat pump according to the disclosure.
Figure 6C:
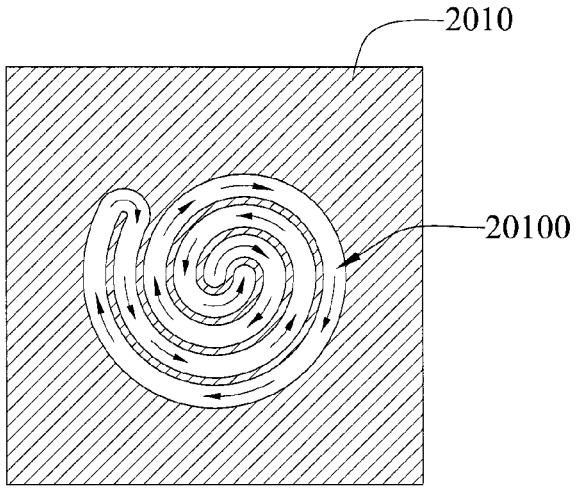
FIG. 6C is a cross-sectional view of the helical channels with a cross-flow type and a thermoelectric heat pump shown in FIG. 6B along a section A.

Furthermore, referring to FIGS. 2 and 6A to 6C, a exploded view of a helical channels with cross-flow type and thermoelectric heat pump 20*d* is shown in FIG. 6A, an assembly view of the helical channels with cross-flow type and thermoelectric heat pump 20*d* is shown in FIG. 6B and a cross-sectional view of helical channels with cross-flow type and thermoelectric heat pump shown on FIG. 6B along a section A is shown in FIG. 6C.

In this embodiment, the principal difference from the helical channels with cross-flow type and of the foregoing embodiment is the arrangement of the inlet and the outlet and the cooling channel 20100 and the heating channel (not shown) are formed of a design of the helical channels with cross-flow type.

As shown in the drawings, the inlet 20123 and the outlet 20124 are provided at the center of the cooling sealing cover 2012, accordingly, the inlet (not shown) and the outlet (not shown) are also provided at the center of the heating sealing cover 2022. In order to more accurately connect the inlet 20123 and the outlet 20124 of the cooling sealing cover 2012 and the inlet and the outlet of the heating sealing cover 2022, a t-pipe cooling cover connector 20125 and a heating cover connector (not shown) may be selectively provided on the cooling sealing cover 2012 and the heating sealing cover 2022.

Such arrangement of the inlet and the outlet used in the cooling channel 20100 and the heating channel of the helical channels with cross-flow type, the flowing of the fluid in the cooling unit 201 and the heating unit 202 will be shown in FIG. 6C. That is, after the fluid flows into through the inlet positioned at the center, the flowing flows in the cooling channel 20100 and the heating channel by way of a helical flow and flows back to the outlet of the center and finally flows out of the outlet of the center. Certainly, according to the actual needs, plural thermoelectric heat pumps 20*d* may be configured to be connected in series or parallel with each other.

Figure 7A:
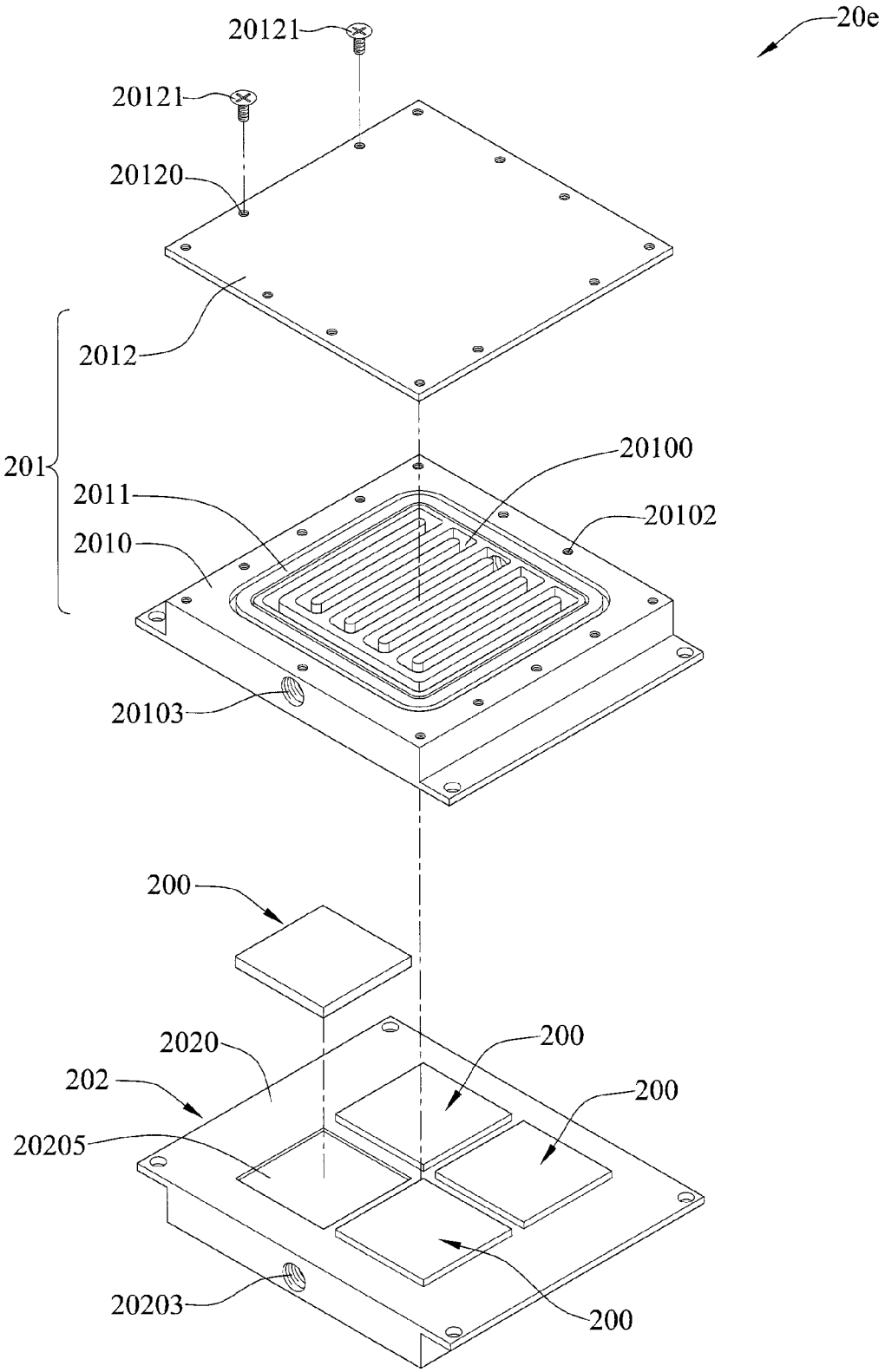
FIG. 7A is an exploded view of U-shaped channels with a cross-flow type and a thermoelectric heat pump according to the disclosure.
Figure 7B:
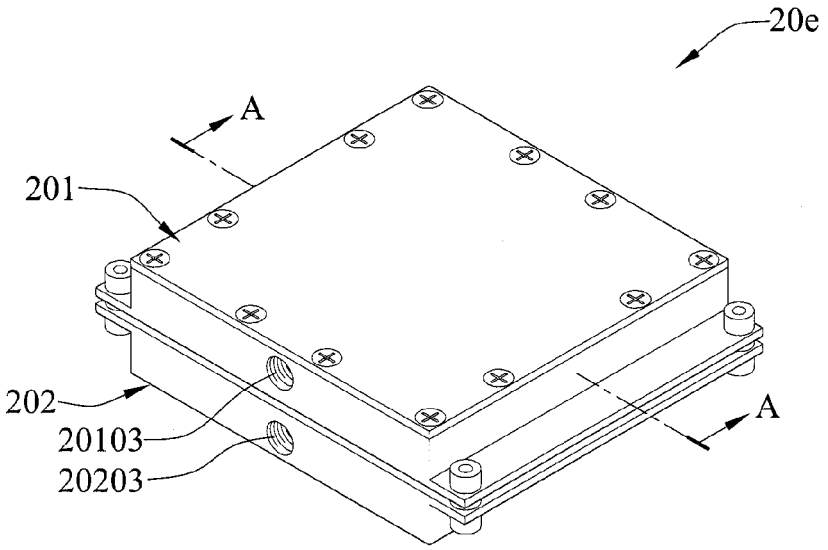
FIG. 7B is an assembly view of the U-shaped channels with a cross-flow type and a thermoelectric heat pump according to the disclosure.
Figure 7C:
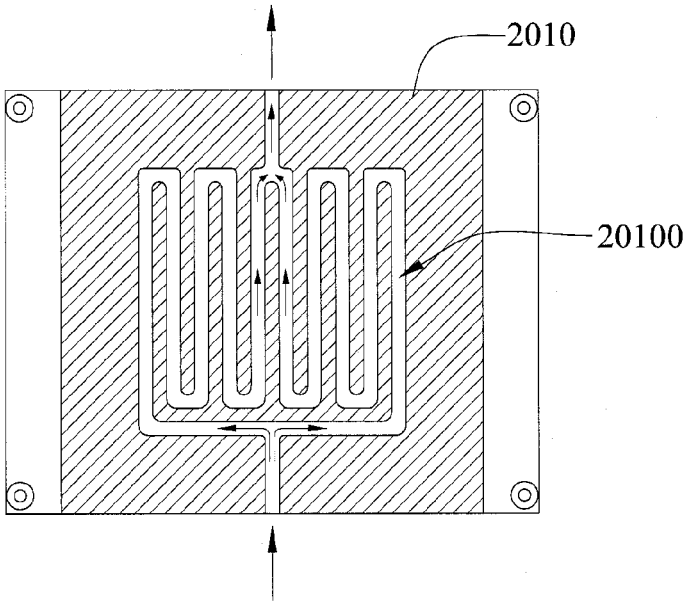
FIG. 7C is a cross-sectional view of the U-shaped channels with a cross-flow type and a thermoelectric heat pump shown in FIG. 7B along a section A.
Figure 7D:
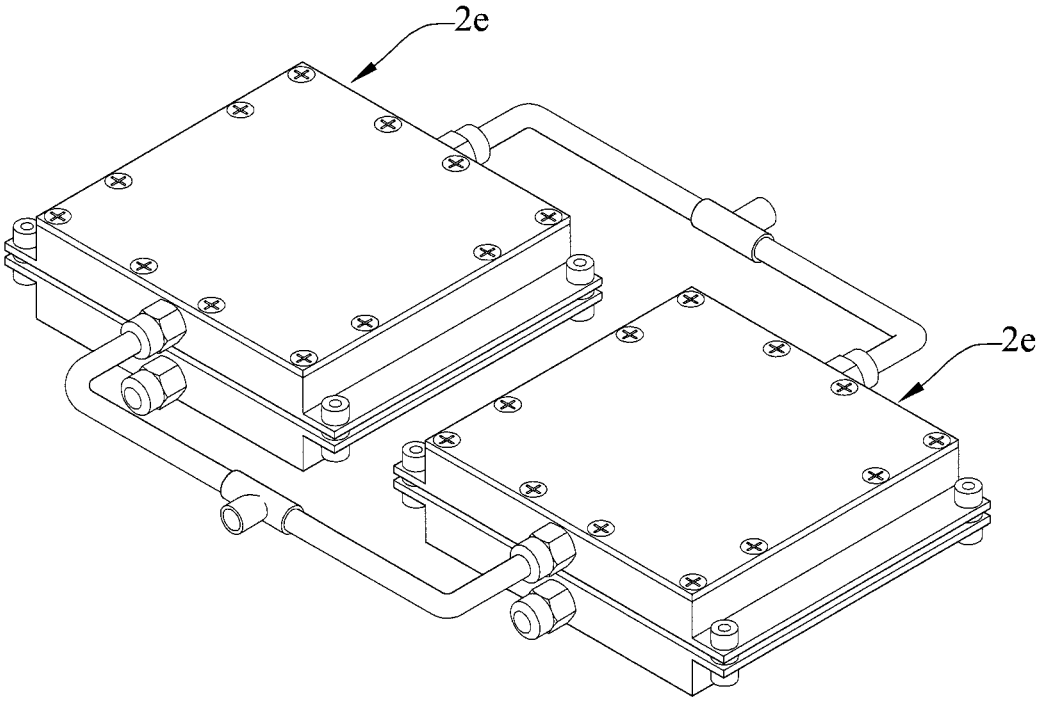
FIG. 7D is a perspective view of a plurality of U-shaped channels with a cross-flow type and a thermoelectric heat pumps connected in parallel.

Finally, referring to FIGS. 2 and 7A to 7D, a exploded view of a U-shaped channels with cross-flow type and thermoelectric heat pump 20*e* is shown in FIG. 7A, an assembly view of the U-shaped channels with cross-flow type and thermoelectric heat pump 20*e* is shown in FIG. 7B, a cross-sectional view of the U-shaped channels with cross-flow type and thermoelectric heat pump 20*e* shown on FIG. 7B along a section A is shown in FIG. 7C and a perspective view of a plurality of U-shaped channels with cross-flow type and thermoelectric heat pumps 20*e* connected in series is shown in FIG. 7D.

The difference from this embodiment and the channels with the inlet and the outlet of flow in the opposite sides of unit of the foregoing embodiment resides in the arrangement of the inlet and the outlet disposed on the central part of the corresponding two sides and the cooling channel 20100 and the heating channel (not shown) are formed of a design of the channels with cross-flow type. This embodiment is also equipped with four thermoelectric chips 200, thereby to provide a better efficiency of cooling and heating.

Therefore, after the fluid flows into the cooling channel 20100 of the cooling unit 201 and the heating channel of the heating unit 202 through the inlet 20103 positioned at the center of the cooling unit 201 and the inlet 20203 positioned at the center of the heating unit 202, the flowing is shunt flow, then the fluid flows to the outlet (not shown) of the central part of the other side of the cooling body 2010 and the heating body 2020 by way of a U-shaped flow to form the flow shown in FIG. 7C. Certainly, in order to provide a better throughput, plural thermoelectric heat pumps 20*e* may be configured to be connected in parallel with each other, as shown in FIG. 7D. In order to obtain stage type cooling effect and heating effect, the plural thermoelectric heat pumps 20*e* may be flexibly configured to be connected in parallel with each other.

It is noteworthy that the cooling unit 201 and the heating unit 202 in the thermoelectric heat pump 20 (20*a*, 20*b*, 20*c*, 20*d* or 20*e*) may be separated as the aforementioned forms or may be molded as a whole in one piece. The configuration of the cooling channel of the cooling unit 201 may be different from the heating channel of the corresponding heating unit 202, in order to increase flexibility of system design.

In summary, the thermoelectric drinking apparatus of the disclosure may cool and heat the fluids in the cooling channel and heating channel by the thermoelectric chip. Water temperature is adjusted during flowing and circulating inside the cooling channel or the heating channel. The disclosure provides a higher cooling efficiency and heating efficiency and decreases the amount of waste heat energy. Furthermore, since the disclosure thermoelectric drinking apparatus need not dispose of compressor, fan, cooling fins, and the like; thus in addition to effectively reducing the overall volume, refrigerant contamination and energy consumption.

While the disclosure has been described in terms of what are presently considered to be the most practical and preferred embodiments, it is to be understood that the disclosure need not limit to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A thermoelectric drinking apparatus comprising:

a thermoelectric heat pump comprising:

a thermoelectric chip having a cold side for absorbing heat and a hot side for rejecting heat;

a cooling unit being attached to the cold side of the thermoelectric chip and having a cooling channel provided therein, the cooling unit comprising a cooling body having the cooling channel and a cooling gasket groove, a cooling sealing gasket disposed in the cooling gasket groove, and a cooling sealing cover covering the cooling body, wherein the cooling channel is defined by a cooling trench in the cooling unit, wherein the cooling sealing cover and the cooling body are each formed with screw holes, the screw holes of the cooling sealing cover corresponding in position to the screw holes of the cooling body for screws to pass through the screw holes of the cooling sealing cover and the screw holes of the cooling body so as to fix the cooling sealing cover onto the cooling body and the cooling sealing gasket in the cooling gasket groove; and a heating unit being attached to the hot side of the thermoelectric chip and having a heating channel provided therein, the heating unit comprising a heating body having the heating channel and a heating gasket groove, a heating sealing gasket disposed in the heating gasket groove, and a heating sealing cover covering the heating body, wherein the heating channel is defined by a heating trench in the heating unit, and wherein the heating sealing cover and the heating body are each formed with screw holes, the screw holes of the heating sealing cover corresponding in position to the screw holes of the heating body for screws to pass through the screw holes of the heating sealing cover and the screw holes of the heating body so as to fix the heating sealing cover onto the heating body and the heating sealing gasket in the heating gasket groove;

a feeding pipe for conducting fluid into the cooling channel of the cooling unit and the heating channel of the heating unit, respectively;

a cooled fluid tank;

a cooling-gain circulating loop coupled to the cooling unit for introducing the fluid from the feeding pipe into the cooling channel to create a cool circular flow, so as to make the cold side of the thermoelectric chip cool the fluid flowing in the cooling channel of the cooling unit, one end of the cooling-gain circulating loop being connected to the cooling unit and another end of the cooling-gain circulating loop being connected to the cooled fluid tank such that the fluid introduced into the cooling channel via the feeding pipe flows circularly;

a heated fluid tank;

a heating-gain circulating loop coupled to the heating unit for introducing the fluid from the feeding pipe into the heating channel to create a heat circular flow, so as to make the hot side of the thermoelectric chip heat the fluid flowing in the heating channel of the heating unit, one end of the heating-gain circulating loop is connected to the heating unit and another end of the heating-gain circulating loop is connected to the heated fluid tank such that the fluid introduced into the heating channel via the feeding pipe flows circularly; and an outlet pipe coupled to the cooling-gain circulating loop and to the heating-gain circulating loop for discharging the cooled fluid and the heated fluid respectively from the cooling-gain circulating loop and the heating-gain circulating loop, wherein the thermoelectric heat pump cools the fluid flowing in the cooling channel of the cooling unit and heats the fluid flowing in the heating channel of the heating unit simultaneously without a fan or a fin, wherein the cool circular flow circulates through the cooling-gain circulating loop, the cooling unit, the cooled fluid tank and back to the cooling-gain circulating loop, and the heat circular flow circulates through the heating-gain circulating loop, the heating unit, the heated fluid tank and back to the heating-gain circulating loop.

2. The thermoelectric drinking apparatus of claim 1, wherein the thermoelectric heat pump comprises a plurality of cooling units and heating units connected in series or parallel with each other.

3. The thermoelectric drinking apparatus of claim 1, wherein the cooling channel and the heating channel are U-shaped contralateral unidirectional channel-type structures.

4. The thermoelectric drinking apparatus of claim 1, wherein the cooling channel and the heating channel are U-shaped ipsilateral unidirectional channel-type structures.

5. The thermoelectric drinking apparatus of claim 1, wherein the cooling channel and the heating channel are helical unidirectional channel-type structures.

6. The thermoelectric drinking apparatus of claim 1, wherein the cooling channel and the heating channel are helical bi-directional channel-type structures.

7. The thermoelectric drinking apparatus of claim 1, wherein the cooling channel and the heating channel are U-shaped contralateral bi-directional channel-type structures.

8. The thermoelectric drinking apparatus of claim 1, wherein the feeding pipe has an inlet valve and a check valve, the inlet valve is used to conduct the fluid into the cooling channel of the cooling unit and the heating channel of the heating unit respectively, and the check valve is used to prevent the fluid conducted by the feeding pipe from flowing in a reverse direction in the cooling channel and the heating channel.

9. The thermoelectric drinking apparatus of claim 1, wherein the cooling-gain circulating loop has a cold control valve for controlling the fluid in the cooling channel to create the cool circular flow, and a cold-side booster pump for improving efficiency of the circular flow of the fluid in the cooling channel, and the cooling-gain circulating loop is used to store the fluid, that is cooled by the thermoelectric chip as cooled fluid, in the cooled fluid tank, and the heating-gain circulating loop has a hot control valve for controlling the fluid in the heating channel to create the heat circular flow, and a hot-side booster pump for improving efficiency of the heat circular flow of the fluid in the heating channel, and the heating-gain circulating loop is used to store the fluid that is heated by the thermoelectric chip as heated fluid, in the heated fluid tank.

10. The thermoelectric drinking apparatus of claim 9, further comprising an insulation layer, wherein the cooled fluid tank and the heated fluid tank are coated with the insulation layer, the insulation layer for maintaining temperatures of the cooled fluid and the heated fluid stored in the cooled fluid tank and the heated fluid tank.

11. The thermoelectric drinking apparatus of claim 9, wherein the cooled fluid tank and the heated fluid tank have switches for discharging the cooled fluid and the heated fluid.

12. The thermoelectric drinking apparatus of claim 9, wherein operation of the cold-side booster pump is terminated and the cold control valve is closed at a time a temperature of the cooled fluid in the cooled fluid tank is below a preset temperature of 8° C., and operation of the hot-side booster pump is terminated and the hot control valve is closed at the time a temperature of the heated fluid in the heated fluid tank is above a preset temperature of 85° C.

13. The thermoelectric drinking apparatus of claim 9, wherein the cold control valve and the hot control valve are closed and the cold-side booster pump and the hot-side booster pump work at a time the outlet pipe discharges the cooled fluid and the heated fluid respectively from the cooling-gain circulating loop and the heating-gain circulating loop.

14. The thermoelectric drinking apparatus of claim 9, wherein the cooled fluid tank and the heated fluid tank provide a predetermined percentage of cooled fluid and heated fluid respectively, so as to mix into warm water with a predetermined temperature.

15. The thermoelectric drinking apparatus of claim 9, wherein the outlet pipe has an outlet valve and a flow control valve, and the outlet valve is used to conduct the cooled and heated fluid from the cooling-gain circulating loop and the heating-gain circulating loop respectively, and the flow control valve is used to control a flow of the outlet pipe.

16. A thermoelectric heat pump including:

a thermoelectric chip having a cold side for absorbing heat and a hot side for releasing heat;

a cooling unit being attached to the cold side of the thermoelectric chip and having a cooling channel provided therein, the cooling unit comprising a cooling body having the cooling channel and a cooling gasket groove, a cooling sealing gasket disposed in the cooling gasket groove, and a cooling sealing cover covering the cooling body, wherein the cooling channel is defined by a cooling trench in the cooling unit, wherein the cooling sealing cover and the cooling body are each formed with screw holes, the screw holes of the cooling sealing cover corresponding in position to the screw holes of the cooling body for screws to pass through the screw holes of the cooling sealing cover and the screw holes of the cooling body so as to fix the cooling sealing cover onto the cooling body and the cooling sealing gasket in the cooling gasket groove;

a cooling-gain circulating loop coupled to the cooling unit for introducing fluid from a feeding pipe into the cooling channel to create a cool circular flow so as to make the cold side of the thermoelectric chip cool the fluid flowing in the cooling channel of the cooling unit, one end of the cooling-gain circulating loop being connected to the cooling unit and another end of the cooling-gain circulating loop being connected to a cooled fluid tank, such that the fluid introduced into the cooling channel via the feeding pipe flows circularly;

a heating unit being attached to the hot side of the thermoelectric chip and having a heating channel provided therein, the hot side of the thermoelectric chip heating fluid in the heating channel, the heating unit comprising a heating body having the heating channel and a heating gasket groove, a heating sealing gasket disposed in the heating gasket groove and a heating sealing cover covering the heating body, wherein the heating channel is defined by a heating trench in the heating unit, wherein the heating sealing cover and the heating body are each formed with screw holes, the screw holes of the heating sealing cover corresponding in position to the screw holes of the heating body for screws to pass through the screw holes of the heating sealing cover and the screw holes of the heating body so as to fix the heating sealing cover onto the heating body and the heating sealing gasket in the heating gasket groove; and a heating-gain circulating loop coupled to the heating unit for introducing the fluid from the feeding pipe into the heating channel to create a heat circular flow so as to make the hot side of the thermoelectric chip heat the fluid flowing in the heating channel of the heating unit, one end of the heating-gain circulating loop being connected to the heating unit and another end of the heating-gain circulating loop being connected to a heated fluid tank, such that the fluid introduced into the heating channel via the feeding pipe flows circularly, wherein the thermoelectric heat pump cools the fluid flowing in the cooling channel of the cooling unit and heats the fluid flowing in the heating channel of the heating unit simultaneously without a fan or a fin, wherein the cool circular flow circulates through the cooling-gain circulating loop, the cooling unit, the cooled fluid tank and back to the cooling-gain circulating loop, and the heat circular flow circulates through the heating-gain circulating loop, the heating unit, the heated fluid tank and back to the heating-gain circulating loop.

17. The thermoelectric heat pump of claim 16, wherein the cooling channel and the heating channel are each U-shaped channel-type structures having an inlet and outlet of flow that are on opposite sides of the heat pump from each other.

18. The thermoelectric heat pump of claim 16, wherein the cooling channel and the heating channel are each U-shaped channel-type structures having an inlet and an outlet of flow at a same side of the heat pump.

19. The thermoelectric heat pump according to claim 16, wherein the cooling channel and the heating channel are helical unidirectional channel-type structures.

20. The thermoelectric heat pump according to claim 16, wherein the cooling channel and the heating channel are helical channel structures with cross-flow types.

21. The thermoelectric heat pump according to claim 16, wherein the cooling channel and the heating channel are U-shaped channel-type structures with cross-flow type.

* * * * *